US009305718B2

(12) United States Patent
Iwamoto

(10) Patent No.: US 9,305,718 B2
(45) Date of Patent: Apr. 5, 2016

(54) ELECTROMAGNETIC RELAY

(71) Applicant: FUJITSU COMPONENT LIMITED, Tokyo (JP)

(72) Inventor: Daiei Iwamoto, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/248,772

(22) Filed: Apr. 9, 2014

(65) Prior Publication Data

US 2015/0002248 A1 Jan. 1, 2015

(30) Foreign Application Priority Data

Jul. 1, 2013 (JP) ..... 2013-138394

(51) Int. Cl.

| | |
|---|---|
| ***H01H 3/00*** | (2006.01) |
| ***H01H 1/50*** | (2006.01) |
| ***H01H 50/56*** | (2006.01) |
| *H01H 51/22* | (2006.01) |
| *H01H 1/26* | (2006.01) |

(52) U.S. Cl.

CPC ..... *H01H 1/50* (2013.01); *H01H 3/001* (2013.01); *H01H 50/56* (2013.01); *H01H 51/2272* (2013.01); *H01H 2001/265* (2013.01)

(58) Field of Classification Search

CPC ..... H01H 1/50; H01H 50/56; H01H 51/22; H01H 1/26; H01H 50/24; H01H 50/641; H01H 50/643; H01H 51/2227

USPC ..... 335/192

See application file for complete search history.

(56) References Cited

U.S. PATENT DOCUMENTS

| | | | | | |
|---|---|---|---|---|---|
| 3,993,971 | A | * | 11/1976 | Ono et al. | 335/202 |
| 4,625,191 | A | * | 11/1986 | Oberndorfer et al. | 335/78 |
| 5,719,541 | A | * | 2/1998 | Mader | 335/78 |
| 5,994,987 | A | * | 11/1999 | Passow | 335/78 |
| 6,020,801 | A | * | 2/2000 | Passow | 335/78 |
| 6,046,660 | A | * | 4/2000 | Gruner | 335/78 |

(Continued)

FOREIGN PATENT DOCUMENTS

| | | |
|---|---|---|
| DE | 1 175 807 | 8/1964 |
| DE | 198 31 658 | 2/2000 |

(Continued)

OTHER PUBLICATIONS

Patent Abstracts of Japan, Publication No. 2001-126601, Published May 11, 2001.

(Continued)

*Primary Examiner* — Shawki S Ismail
*Assistant Examiner* — Lisa Homza
(74) *Attorney, Agent, or Firm* — Staas & Halsey LLP

(57) ABSTRACT

An electromagnetic relay, includes: a first movable contact that comes in contact with a first fixed contact; a second movable contact that comes in contact with a second fixed contact; a first elastic body that biases the first movable contact; a second elastic body that biases the second movable contact; a pressing member that presses the first elastic body and contacts the first movable contact to the first fixed contact, presses the second elastic body and contacts the second movable contact to the second fixed contact; wherein the pressing member contacts the second movable contact to the second fixed contact before contacting the first movable contact to the first fixed contact.

9 Claims, 13 Drawing Sheets

(56) References Cited

U.S. PATENT DOCUMENTS

| | | | | |
|---|---|---|---|---|
| 6,788,176 | B2 * | 9/2004 | Schmelz | 335/80 |
| 7,477,119 | B2 * | 1/2009 | Wu | 335/83 |
| 8,203,403 | B2 * | 6/2012 | Moeller et al. | 335/78 |
| 8,222,981 | B1 * | 7/2012 | Zarbock et al. | 335/128 |
| 8,222,982 | B2 * | 7/2012 | Sullivan et al. | 335/166 |
| 8,237,523 | B2 * | 8/2012 | Helmreich | 335/83 |
| 8,564,386 | B2 * | 10/2013 | Moeller et al. | 335/78 |
| 2004/0080388 | A1 | 4/2004 | Schmelz | |
| 2009/0033446 | A1 * | 2/2009 | Gruner et al. | 335/129 |
| 2009/0033447 | A1 * | 2/2009 | Gruner et al. | 335/189 |
| 2013/0278362 | A1 | 10/2013 | Iwamoto et al. | |

FOREIGN PATENT DOCUMENTS

| | | |
|---|---|---|
| EP | 2 551 868 A1 | 1/2013 |
| JP | 6-76717 | 3/1994 |
| JP | 2001-126601 | 5/2001 |
| JP | 2013-30310 | 2/2013 |
| JP | 2013-222699 | 10/2013 |

OTHER PUBLICATIONS

Patent Abstracts of Japan, Publication No. 2013-030310, Published Feb. 7, 2013.

Patent Abstracts of Japan, Publication No. 2013-222699, Published Oct. 28, 2013.

Patent Abstracts of Japan, Publication No. 06-076717, Published Mar. 18, 1994.

Espacenet Abstract, Publication No. 19831658, Published Feb. 3, 2000.

European Search Report of Application No. 14163449.3 mailed Dec. 10, 2014.

* cited by examiner

ELECTROMAGNETIC RELAY

CROSS-REFERENCE TO RELATED APPLICATION

This application is based upon and claims the benefit of priority of the prior Japanese Patent Application No. 2013-138394 filed on Jul. 1, 2013, the entire contents of which are incorporated herein by reference.

FIELD

A certain aspect of the embodiments is related to an electromagnetic relay, e.g. an electromagnetic relay that includes a pressing member which presses an elastic body biasing a movable contact.

BACKGROUND

For example, in Japanese Laid-open Patent Publication No. 2001-126601, an electromagnetic relay includes a yoke which can change a magnetic pole by an electromagnet, and an armature magnetized with a permanent magnet. The polarity of the electromagnet is changed, so that the magnetic pole of the yoke is changed. Thereby, the armature comes in contact with the yoke or detaches from the yoke. The movable contact is biased by an elastic body, and the pressing member presses the elastic body according to the operation of the armature. Thereby, the fixed contact comes in contact with the movable contact or detaches from the movable contact. Therefore, this function as the electromagnetic relay.

SUMMARY

According to an aspect of the present invention, there is provided an electromagnetic relay, including: a first movable contact that comes in contact with a first fixed contact; a second movable contact that comes in contact with a second fixed contact; a first elastic body that biases the first movable contact; a second elastic body that biases the second movable contact; a pressing member that presses the first elastic body and contacts the first movable contact to the first fixed contact, presses the second elastic body and contacts the second movable contact to the second fixed contact; wherein the pressing member contacts the second movable contact to the second fixed contact before contacting the first movable contact to the first fixed contact.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

In Japanese Laid-open Patent Publication No. 2001-126601, when the fixed contact comes in contact with the movable contact or detaches from the movable contact, a bounce by the collision of the fixed contact and the movable contact occurs. When an energizing current is large, arc discharge occurs in the case of the bounce. Contact welding occurs by the heat of the arc discharge, and the contacts become defect. Rolling of one contact exists as this measure. However, when the energizing current is large, a cross-sectional area of a spring of the contact is enlarged, so that the bending of the spring for leading the rolling cannot be secured adequately.

A description will now be given of embodiment of the present invention with reference to the drawings.

First Embodiment

Figure 1:
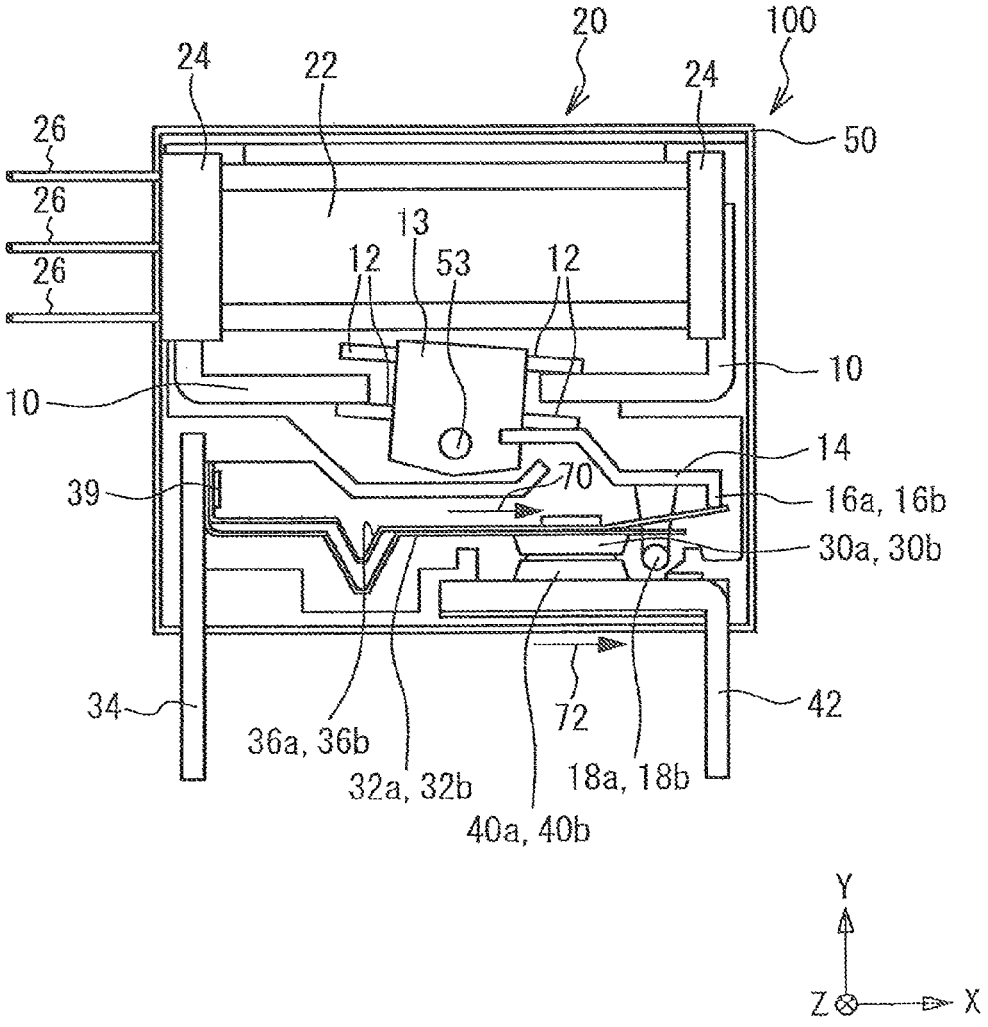
FIG. 1 is a side view of an electromagnetic relay according to a first embodiment.

FIG. 1 is a cross-sectional view of an electromagnetic relay according to a first embodiment. FIGS. 1A-1D are enlarged views of a portion of the embodiment shown in FIG. 1. In FIG. 1, a base cover is removed from the electromagnetic relay. It is assumed that a direction of a pair of yokes 10 is an X-direction, a direction which intersects perpendicularly in the X-direction of X is a Y-direction, and a direction perpendicular to this paper surface is a Z-direction. Also in the following drawings, the X-, Y- and Z-directions are illustrated similarly. In the electromagnetic relay 100, a base 50 houses an electromagnet 20, yokes 10, armatures 12, an armature cover 13, a first contact pressing portion 16*a*, a second contact pressing portion 16*b*, a first detachment pressing portion 18*a*, a second detachment pressing portion 18*b*, a connection member 14, a first movable contact 30*a*, a second movable contact 30*b*, springs 32*a* and 32*b*, a movable terminal 34, springs 36*a* and 36*b*, a first fixed contact 40*a*, a second fixed contact 40*b*, and a fixed terminal 42.

In the electromagnet 20, a coil wire 22 is wound around a bobbin 24. Terminals 26 are electrically connected to the coil wire 22. A pair of yokes 10 is magnetically connected to both sides of the electromagnet 20. The magnetic poles of respective ends of a pair of yokes 10 are opposite to each other. When the direction of a current which flows into the coil wire 22 is changed, the polarity of the electromagnet 20 is reversed. Thus, the magnetic poles of the yokes 10 can be changed with the electromagnet. The armatures 12 are magnetized with a permanent magnet, and come in contact with the yokes 10 or detach from the yokes 10 by the magnetic poles of the yokes 10. A part of the armatures 12 and the permanent magnet (not shown) are fixed by the armature cover 13.

The first movable contact 30*a* is electrically connected to the movable terminal 34 via the spring 32*a* (a first elastic body). The second movable contact 30*b* is electrically connected to the movable terminal 34 via the spring 32*b* (a second elastic body). The springs 32*a* and 32*b* are fixed to the movable terminal 34 with a fixed portion 39. The first fixed contact 40*a* and the second fixed contact 40*b* are electrically connected to the fixed terminal 42. When the first movable contact 30*a* comes in contact with the first fixed contact 40*a*, and the second movable contact 30*b* comes in contact with the second fixed contact 40*b*, the movable terminal 34 is electrically connected to the fixed terminal 42. When the first movable contact 30*a* detaches from the first fixed contact 40*a*, and the second movable contact 30*b* detaches from the second fixed contact 40*b*, the movable terminal 34 and the fixed terminal 42 become non-conductive electrically.

Figure 1A:
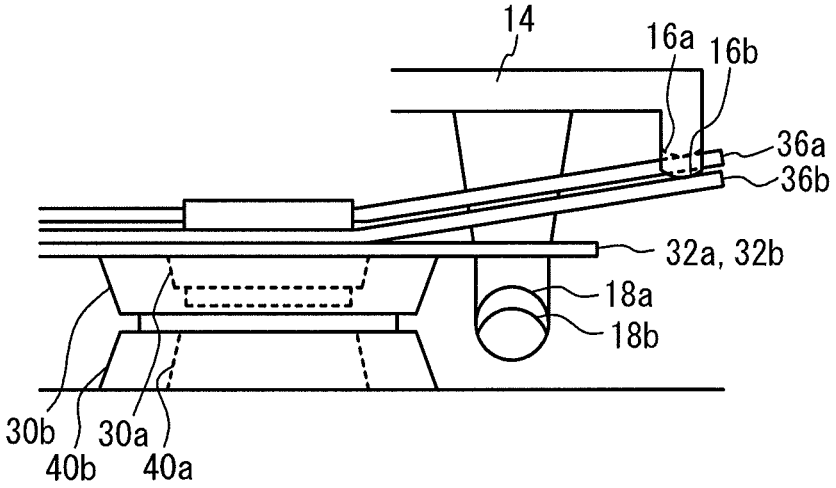
FIGS. 1A-1D are enlarged views of a portion of the embodiment shown in FIG. 1
Figure 1B:
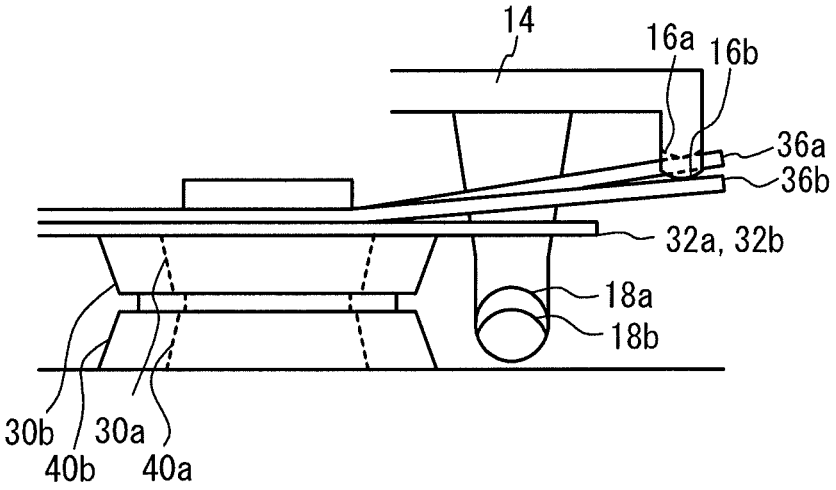
Figure 1C:
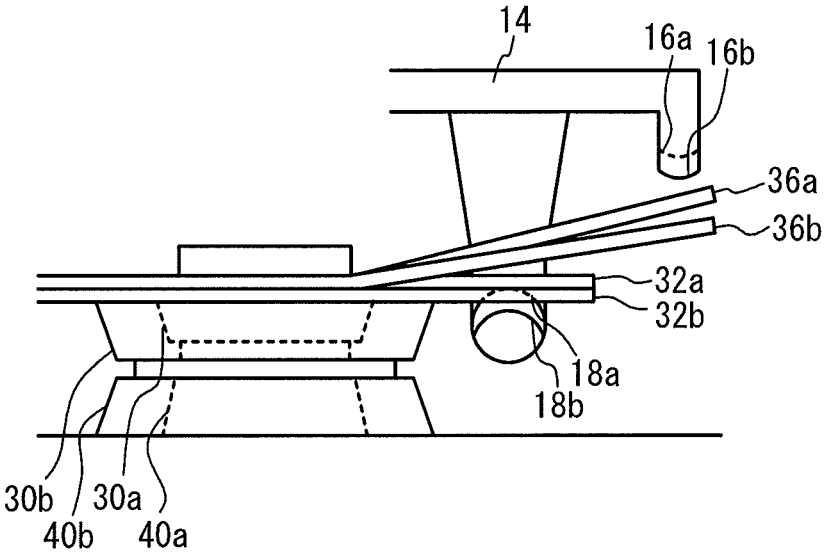

The first movable contact 30*a* is biased by the springs 32*a* and 36*a* so as to detach from the first fixed contact 40*a*. As illustrated in FIG. 1A, the first contact pressing portion 16*a* presses the springs 32*a* and 36*a* in a −Y direction, so that the first movable contact 30*a* comes in contact with the first fixed contact 40*a*. As illustrated in FIG. 1C, the first detachment pressing portion 18*a* presses the springs 32*a* and 36*a* in a +Y direction, so that the first movable contact 30*a* detaches from the first fixed contact 40*a*.

Figure 1D:
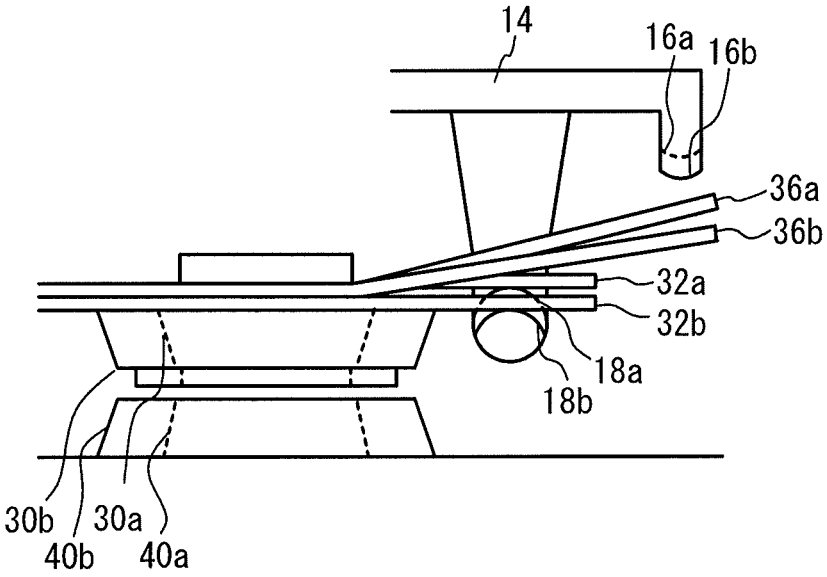

The second movable contact 30*b* is biased by the springs 32*b* and 36*b* so as to detach from the second fixed contact 40*b*. As illustrated in FIG. 1B, the second contact pressing portion 16*b* presses the springs 32*b* and 36*b* in the −Y direction, so that the second movable contact 30*b* comes in contact with the second fixed contact 40*b*. As illustrated in FIG. 1D, the second detachment pressing portion 18*b* presses the springs 32*b* and 36*b* in the +direction, so that the second movable contact 30*b* detaches from the second fixed contact 40*b*. Here, in the above-mentioned example, a plurality of blade springs such as the springs 32*a* and 36*a* are used as the first elastic body, and another plurality of blade springs such as the springs 32*b* and 36*b* are used as the second elastic body. The first elastic body and the second elastic body should be members which bias the first movable contact 30*a* and the second movable contact 30*b*, respectively.

The connection member 14 connects the first contact pressing portion 16*a*, the second contact pressing portion 16*b*, the first detachment pressing portion 18*a* and the second detachment pressing portion 18*b* with the armature cover 13.

Figure 2:
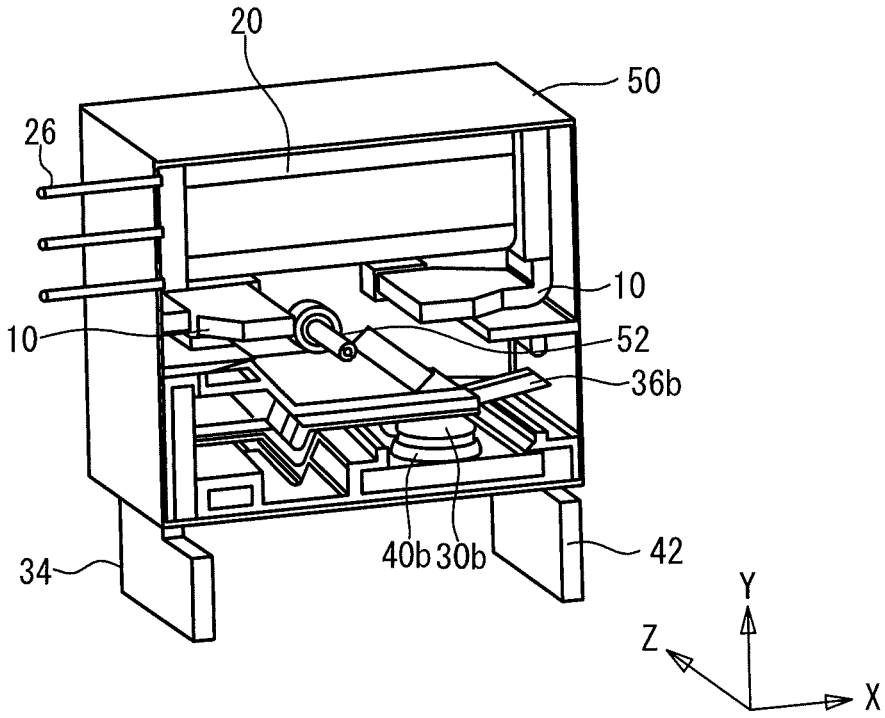
FIG. 2 is a perspective view of the electromagnetic relay removing an armature cover and a connection member.

FIG. 2 is a perspective view of the electromagnetic relay removing the armature cover 13 and the connection member 14. As illustrated in FIG. 2, a base rotary-shaft-projection 52 is formed on the base 50. Since other configurations are the same as those of FIG. 1, description thereof is omitted.

Figure 3:
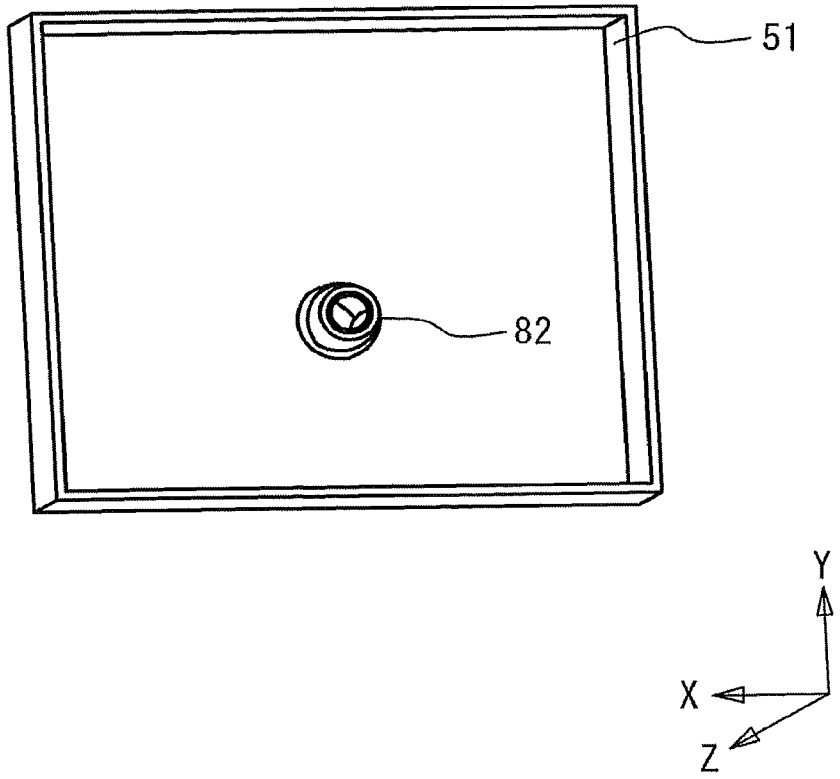
FIG. 3 is a perspective view of a base cover.

FIG. 3 is a perspective view of a base cover 51. As illustrated in FIG. 3, a cover rotation bearing 82 is formed on the base cover 51.

Figure 4:
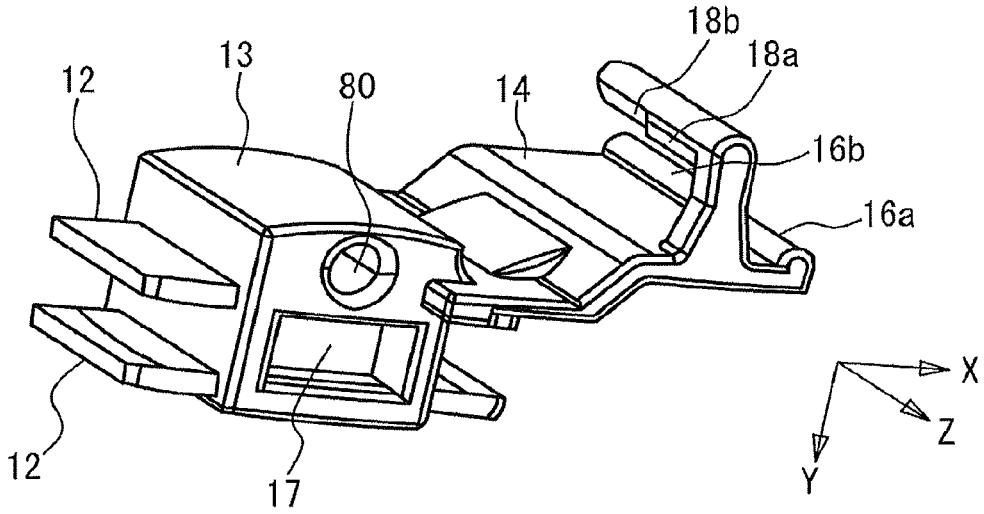
FIG. 4 is a perspective view illustrating an armature and the connection member.
Figure 5:
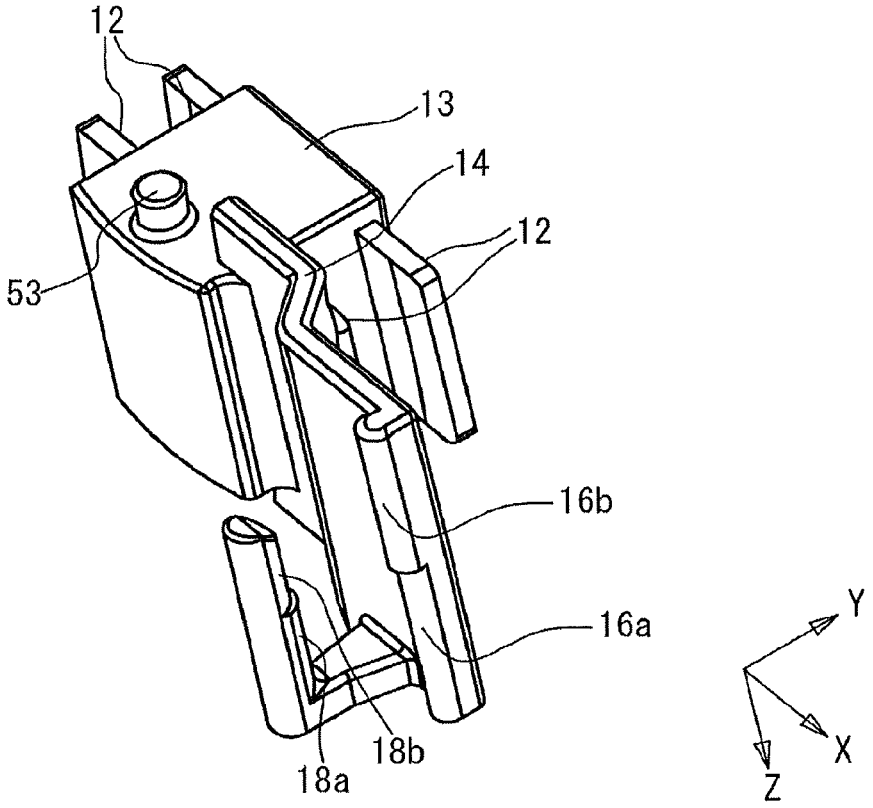
FIG. 5 is a perspective view illustrating the armature and the connection member.
Figure 6:
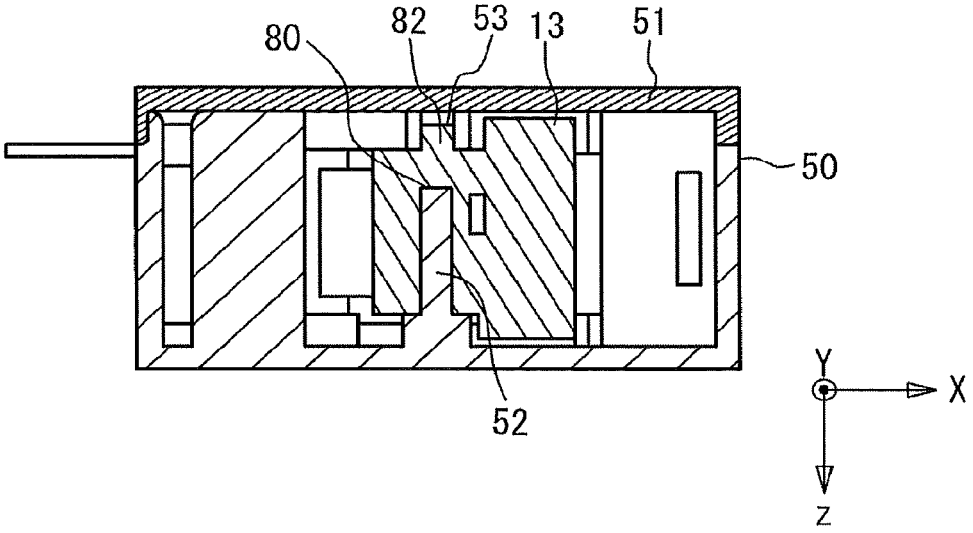
FIG. 6 is a cross-sectional view of a base and the armature cover in an XZ plane.

FIGS. 4 and 5 are perspective views illustrating the armature and the connection member. FIG. 6 is a cross-sectional view of the base and the armature cover in an XZ plane. As illustrated in FIGS. 4 to 6, a concave portion is formed on the armature cover 13, and a permanent magnet 17 is embedded in the concave portion. An armature rotation bearing 80 and an armature rotary-shaft-projection 53 are formed on the armature cover 13. The base rotary-shaft-projection 52 of FIG. 2 is inserted into the armature rotation bearing 80. The armature rotary-shaft-projection 53 is inserted into the cover rotation bearing 82 of FIG. 3.

A pressing member is formed at the tip of the connection member 14. The pressing member includes the first contact pressing portion 16*a*, the second contact pressing portion 16*b*, the first detachment pressing portion 18*a* and the second detachment pressing portion 18*b*. A step is formed between the second contact pressing portion 16*b* and the first contact pressing portion 16*a* so that the second contact pressing portion 16*b* projects in the −Y direction compared with the first contact pressing portion 16*a*. Thereby, a distance from the spring 36*a* to the first contact pressing portion 16*a* becomes longer than a distance from the spring 36*b* to the second contact pressing portion 16*b*. A step is formed between the first detachment pressing portion 18*a* and the second detachment pressing portion 18*b* so that the first detachment pressing portion 18*a* projects in the +Y direction, compared with the second detachment pressing portion 18*b*. Thereby, a distance from the spring 32*a* to the first detachment pressing portion 18*a* becomes shorter than a distance from the spring 32*b* to the second detachment pressing portion 18*b*.

The armature cover 13, the connection member 14, and the pressing portions 16*a*, 16*b*, 18*a* and 18*b* are integrally formed with resin, for example.

The springs 32*a*, 32*b*, 36*a* and 36*b* are not integrally formed with the armature cover 13, the connection member 14, and the pressing portions 16*a*, 16*b*, 18*a* and 18*b*, and can be separated from the pressing portions 16*a*, 16*b*, 18*a* and 18*b*.

By pressing the first elastic body (the springs 32*a* and 32*b*), the pressing portions 16*a* and 16*b* cause the first movable contact 30*a* and 30*b* to contact with the first fixed contact 40*a* and 40*b*. By pressing the second elastic body (the springs 36*a* and 36*b*), the pressing portions 18*a* and 18*b* cause the second movable contact 30*a* and 30*b* to detach from the second fixed contact 40*a* and 40*b*.

Figure 7A:
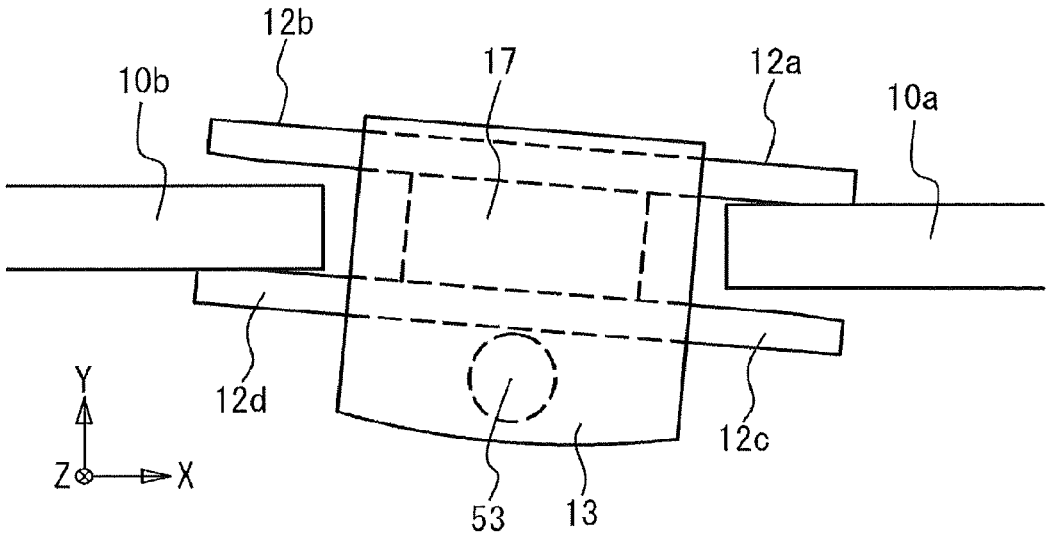
FIGS. 7A and 7B are views illustrating the operation of the armature.
Figure 7B:
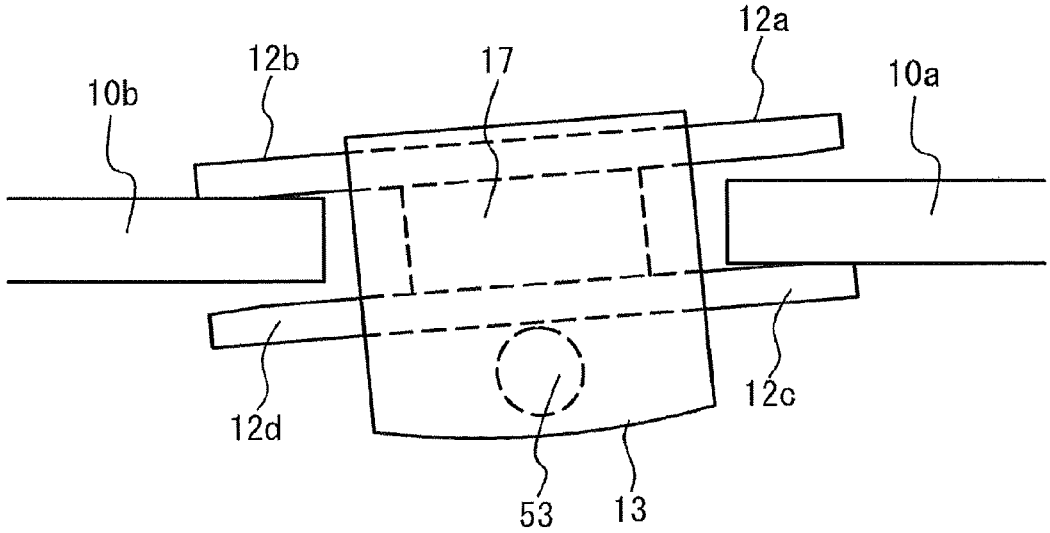

FIGS. 7A and 7B are views illustrating the operation of the armature. Referring to FIG. 7A, when an end 10*a* of one of the yokes 10 and the armatures 12*c* and 12*d* have the same polarity, and an end 10*b* of another one of the yokes 10 and the armatures 12*a* and 12*b* have the same polarity, the armatures rotate so that the armature 12*a* comes in contact with the end 10*a* and the armature 12*d* comes in contact with the end 10*b*. Referring to FIG. 7B, when the end 10*a* and the armatures 12*a* and 12*b* have the same polarity, the end 10*b* and the armatures 12*c* and 12*d* have the same polarity, and the armatures rotate so that the armature 12*c* comes in contact with the end 10*a* and the armature 12*b* comes in contact with the end 10*b*. Thus, a pair of yokes 10 are provided. The armatures 12 are formed so as to sandwich each of the ends 10*a* and 10*b* of the pair of yokes 10. The armature cover 13 rotates, so that the armatures 12 come in contact with the ends 10*a* and 10*b* or detach from the ends 10*a* and 10*b*. Cost reduction can be performed by making the two armatures 12 into the same shape, for example.

The armature rotary-shaft-projection 53 is not arranged on a central line of the yokes 10, and is arranged on the outside of the pair of armatures 12. Therefore, a volume of the permanent magnet 17 located between the armatures 12 can be secured adequately, and a relay excellent in shock resistance can be offered.

Figure 8:
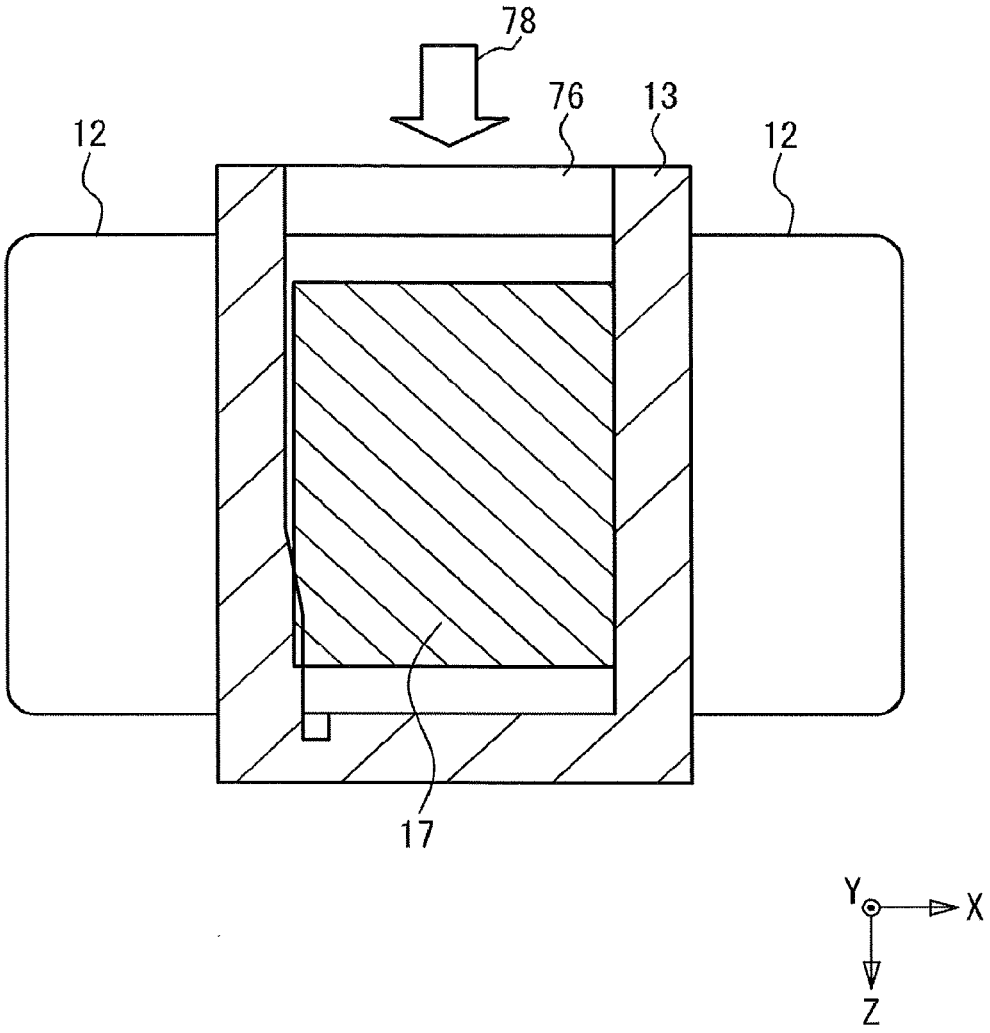
FIG. 8 is a cross-sectional view of the armature cover in the XZ plane.

FIG. 8 is a cross-sectional view of the armature cover in the XZ plane. After integral mold forming of the armature cover 13 and the pressing member is performed, the permanent magnet 17 is inserted from an insertion slot 76 as illustrated by an arrow 78 of FIG. 8. The permanent magnet 17 may be embedded by mold forming. However, in this case, the equipment for performing magnetization to the armatures 12 is used after mold forming. When the permanent magnet 17 is inserted after mold forming as illustrated in FIG. 8, the size of the permanent magnet 17 can be changed easily. Thereby, the magnetization can be performed easily. Therefore, the equipment for performing the magnetization to the armatures 12 becomes unnecessary. In addition, series products of the electromagnetic relay by the performance and cost are enabled. For example, a samarium-cobalt magnet can be used as the permanent magnet 17.

Figure 9:
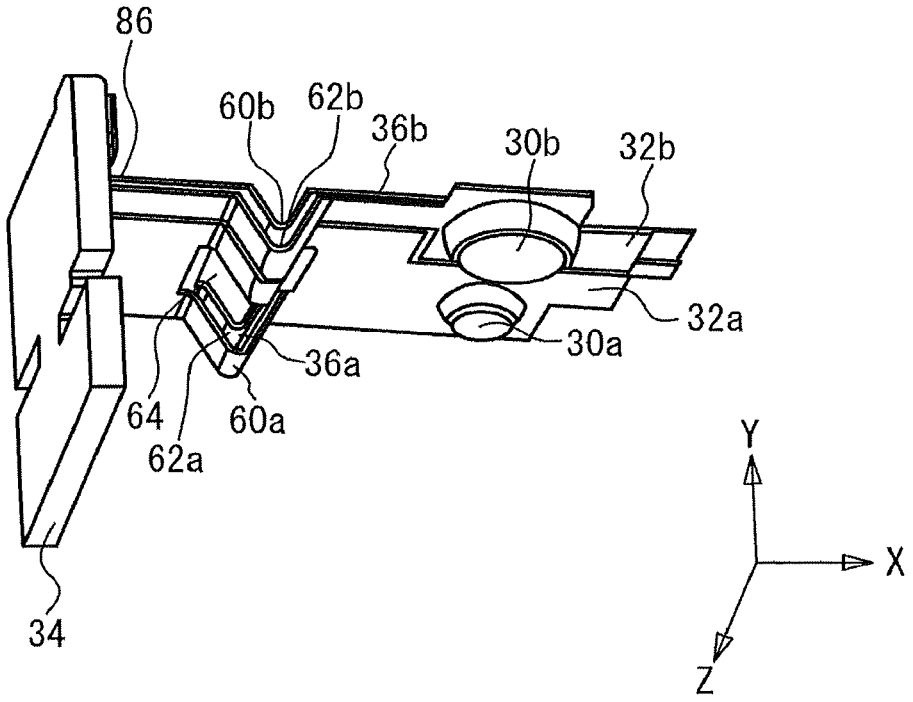
FIG. 9 is a view perspective illustrating the configuration of the circumference of the movable contact.
Figure 10:
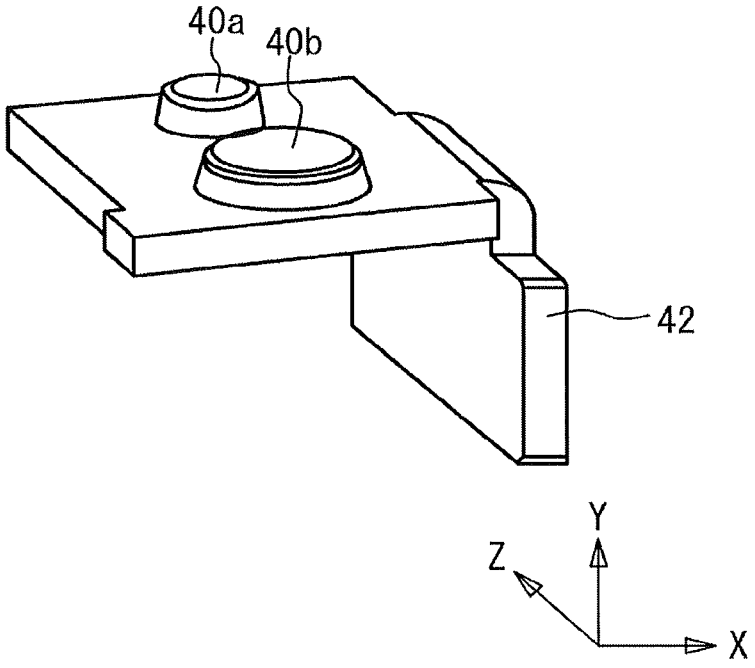
FIG. 10 is a view perspective illustrating the configuration of the circumference of the fixed contact.
Figure 11:
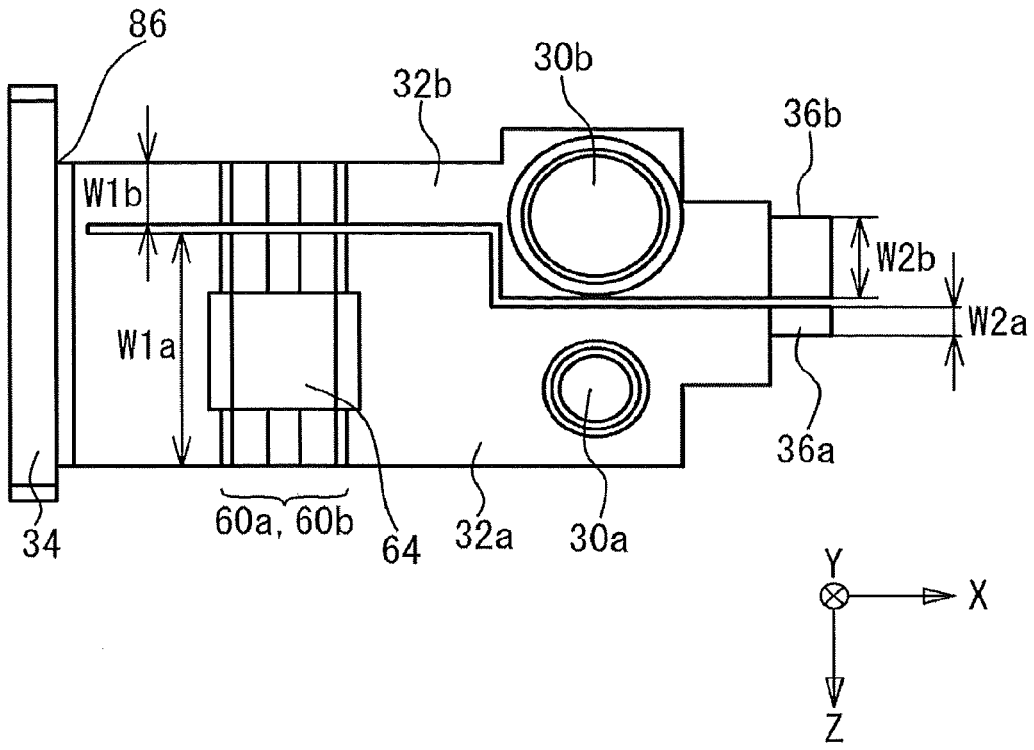
FIG. 11 is a plane view of the movable contact.

FIG. 9 is a view perspective illustrating the configuration of the circumference of the movable contact. FIG. 10 is a perspective view illustrating the configuration of the circumference of the fixed contact. FIG. 11 is a plane view of the movable contact. The pressing portions 16*a* and 16*b* contact the second movable contact 30*b* to the second fixed contact 40*b* (FIG. 1A), before contacting the first movable contact 30*a* to the first fixed contact 40*a* (FIG. 1B). Thus, a time lag is provided in the contact between the two sets of contacts. Thereby, the fixed contact and the movable contact which contact early can take charge of the heat of the arc discharge by the bounce at the time of contact. Here, each of the first elastic body and the second elastic body may be a single spring.

Moreover, the first movable contact 30*a* is smaller than the second movable contact 30*b*, as illustrated in FIGS. 9 to 11. The first fixed contact 40*a* is smaller than the second fixed contact 40*b*. The second fixed contact 40*b* and the second movable contact 30*b* which are relatively large come in contact with each other before the first fixed contact 40*a* and the first movable contact 30*a* which are relatively small come in contact with each other. Therefore, the pair of the fixed contact and the movable contact which have large volumes can take charge of the heat of the arc discharge by the bounce at the time of the contact. Since a large contact has a permissible dose of the heat larger than a small contact, it is possible to avoid a failure by the welding.

Moreover, the pressing portions 18*a* and 18*b* detach the second movable contact 30*b* from the second fixed contact 40*b* (FIG. 1D) after detaching the first movable contact 30*a* from the first fixed contact 40*a* (FIG. 1C). Thus, a time lag is provided in the detachment between the two sets of contacts. Thereby, at the time of the detachment, small contacts are mutually detached first (the current is not interrupted at this time), and then large contacts are mutually detached (the current is interrupted at this time). Therefore, the contacts having a large heat capacity also can take charge of the arc discharge at the time of the detachment. The large contacts take charge of the arc discharge which occurs at the time of the contact and the detachment. Since the small contacts do not take charge of the arc discharge, the small contacts do not receive damage, and hence an effect of reducing a contact resistance of the movable contact and the fixed contact at the time of the contact of the movable contact and the fixed contact can be expected.

Moreover, the first contact pressing portion 16*a* presses the first elastic body to contact the first movable contact 30*a* to the first fixed contact 40*a* (FIG. 1A). The second contact pressing portion 16*b* presses the second elastic body to contact the second movable contact 30*b* to the second fixed contact 40*b* (FIG. 1B). The distance from the spring 36*a* (i.e., the first elastic body) to the first contact pressing portion 16*a* is longer than the distance from the spring 36*b* (i.e., the second elastic body) to the second contact pressing portion 16*b*. Thereby, a time lag can be provided in the contact between the two sets of contacts.

Moreover, the first detachment pressing portion 18*a* (i.e., a first detachment portion) presses the first elastic body to detach the first movable contact 30*a* from the first fixed contact 40*a* (FIG. 1C). The second detachment pressing portion 18*b* (i.e., a second detachment portion) presses the second elastic body to detach the second movable contact 30*b* from the second fixed contact 40*b* (FIG. 1D). The distance from the spring 32*a* (i.e., the first elastic body) to the first detachment pressing portion 18*a* is shorter than the distance from the spring 32*b* (i.e., the first elastic body) to the second detachment pressing portion 18*b*. Thereby, a time lag can be provided in the detachment between the two sets of contacts.

Moreover, a width W1a of the first elastic body between the first movable contact 30*a* and a fixed portion 86 of the first elastic body is wider than a width W1b of the second elastic body between the second movable contact 30*b* and the fixed portion 86 of the second elastic body, as illustrated in FIG. 11. Thereby, bending of the first elastic body for the movable contact that first comes in contact with the fixed contact can be enlarged, and rolling effects can be more exerted.

Moreover, a width W2a of the first elastic body of a portion (i.e., a position) with which the first contact pressing portion 16*a* comes in contact is narrower than a width W2b of the second elastic body of a portion (i.e., a position) with which the second contact pressing portion 16*b* comes in contact, as illustrated in FIG. 11. Thereby, bending of the first elastic body for the movable contact that first comes in contact with the fixed contact can be enlarged, and rolling effects can be more exerted.

Moreover, the springs 32*a* and 36*a* include curved portions 60*a* and 62*a* which curve into a V-shape between the first movable contact 30*a* and the fixed portion 86, as illustrated in FIGS. 9 and 11. The springs 32*b* and 36*b* include curved portions 60*b* and 62*b* which curve into a V-shape between the second movable contact 30*b* and the fixed portion 86, as illustrated in FIGS. 9 and 11. Thereby, bending of the elastic bodies can be secured.

Moreover, the springs 32*a* and 36*a* include an opening 64 in the curved portions 60*a* and 62*a*. Thereby, bending of the elastic body can be secured.

Moreover, the first elastic body includes two springs which are the spring 36*a* (i.e., a third elastic body) and the spring 32*a* (i.e., a fourth elastic body) arranged so as to overlap with the spring 36*a*, as illustrated in FIG. 9. In an example of FIG. 9, the spring 36*a* is pressed by the first contact pressing portion 16*a*, and the spring 32*a* is pressed by the first detachment pressing portion 18*a*. The second elastic body includes two springs which are the spring 36*b* (i.e., a fifth elastic body) and the spring 32*b* (i.e., a sixth elastic body) arranged so as to overlap with the spring 36*b*. In the example of FIG. 9, the spring 36*b* is pressed by the second contact pressing portion 16*b*, and the spring 32*b* is pressed by the second detachment pressing portion 18*b*. Since each of the first elastic body and the second elastic body has a plurality of blade springs, an energizing current can be enlarged. In addition, the springs 32*a* and 32*b* are made thicker than the springs 36*a* and 36*b*. Thereby, each of the first elastic body and the second elastic body can be made soft at the time of the contact, and can be hardened at the time of the detachment.

Moreover, the springs 32*a* and 32*b* serve as current pathways. Therefore, material with high conductivity is used for the springs 32*a* and 32*b*. On the contrary, since the springs 36*a* and 36*b* are formed independently from the springs 32*a* and 32*b*, material with high spring characteristic can be used for the springs 36*a* and 36*b*. A copper alloy, such as a Cu—Cr based alloy with high conductivity or a Cu—Fe based alloy with high conductivity, can be used as the springs 32*a* and 32*b*. Phosphor bronze, such as a Cu—Sn based alloy with high spring characteristic, can be used as the springs 36*a* and 36*b*. Moreover, when a Cu—Cr—Zr—Si based alloy with high conductivity and high spring characteristic is used as the springs 36*a* and 36*b*, the rise in temperature of the electromagnetic relay when a current is supplied can be controlled. Moreover, the resistance characteristic of the spring by repetition operation can be improved. Here, the Cu—Cr—Zr—Si based alloy may be used for the springs 32*a* and 32*b*.

Moreover, since the movable terminal 34 and the fixed terminal 42 are arranged as illustrated in FIG. 1, a direction of a current (hereinafter referred to as "a current direction 70") which flows into the first movable contact 30*a* and flows out from the first movable contact 30*a*, and a direction of a current (hereinafter referred to as "a current direction 72") which flows into the first fixed contact 40*a* and flows out from the first fixed contact 40*a* are the same direction. The current direction 70 which flows into the second movable contact 30*b* and flows out from the second movable contact 30*b*, and the current direction 72 which flows into the second fixed contact 40*b* and flows out from the second fixed contact 40*b* are the same direction.

That is, the current direction 70 which flows into the first movable contact 30*a* and the second movable contact 30*b* from the movable terminal 34, and the current direction 72 which flows out from the first fixed contact 40*a* and the second fixed contact 40*b* to the fixed terminal 42 are the same direction. Alternatively, a current direction (i.e., a direction opposite to the direction 70) which flows out from the first movable contact 30*a* and the second movable contact 30*b* to the movable terminal 34, and a current direction (i.e., a direction opposite to the direction 72) which flows into the first fixed contact 40*a* and the second fixed contact 40*b* from the fixed terminal 42 are the same direction.

When a large current (for example, several thousand amperes) flows by the malfunction of a system, and the current directions 70 and 72 are opposite directions mutually, an electromagnetic repulsive force arises between the contacts by Ampere's corkscrew law. Therefore, a force acts on a direction where the movable contact which is in a contact state detaches, the arc discharge occurs when the movable contact detaches, and hence the contact welding may arise. However, according to the first embodiment, since the current directions 70 and 72 are the same directions, the detachment of the movable contact can be controlled even when the large current flows.

As illustrated in FIG. 1, the fixed terminal 42 and the movable terminal 34 are pulled out in the −Y direction from mutual different positions (the +X side and the −X side), as viewed from the contacts. Thereby, the fixed terminal 42 and the movable terminal 34 can be shortened, compared with a case where the fixed terminal 42 and the movable terminal 34 are pulled out in the −Y direction from the same contact side (e.g. the −X side of the contact). Moreover, a space for forming the curved portions 60*a*, 60*b*, 62*a* and 62*b* can be provided.

When slight contact welding occurs, the rotary shaft of the armature cover 13 inclines and the rotation is inhibited. Thereby, it becomes difficult to detach the contacts from each other even when the slight welding is essentially detachable. According to the first embodiment, the armature rotation bearing 80 and the armature rotary-shaft-projection 53 are formed on the armature cover 13, as illustrated in FIGS. 2 to 6. The base rotary-shaft-projection 52 is inserted into the armature rotation bearing 80. The armature rotary-shaft-projection 53 is inserted into the cover rotation bearing 82. Thereby, the armature cover 13 can rotate efficiently. Therefore, the welding of the contacts can be controlled.

Moreover, a distance from the springs 32*a* and 32*b* to the detachment pressing portions 18*a* and 18*b* when the detachment pressing portions 18*a* and 18*b* are detached from the springs 32*a* and 32*b* is longer than a distance from the springs 32*a* and 32*b* to the contact pressing portion 16*a* and 16*b* when the contact pressing portion 16*a* and 16*b* are detached from the springs 32*a* and 32*b*. Thereby, when the detachment pressing portions 18*a* and 18*b* come in contact with the springs 32*a* and 32*b*, the detachment pressing portions 18*a* and 18*b* having a speed collide with the springs 32*a* and 32*b*. This collision can tear off the movable contact. Therefore, welding failure of the contacts can be more controlled.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. An electromagnetic relay, comprising:

a first movable contact that comes in contact with a first fixed contact;

a second movable contact that comes in contact with a second fixed contact;

a first elastic body that biases the first movable contact;

a second elastic body that biases the second movable contact; and a pressing member that presses the first elastic body and contacts the first movable contact to the first fixed contact, presses the second elastic body and contacts the second movable contact to the second fixed contact, wherein the pressing member contacts the second movable contact to the second fixed contact before contacting the first movable contact to the first fixed contact;

the pressing member includes a first contact pressing portion that presses the first elastic body, and a second contact pressing portion that presses the second elastic body; and a distance from the first elastic body to the first contact pressing portion is longer than a distance from the second elastic body to the second contact pressing portion.

2. The electromagnetic relay as claimed in claim 1, wherein contact volumes of the second movable contact and the second fixed contact are larger than contact volumes of the first movable contact and the first fixed contact.

3. The electromagnetic relay as claimed in claim 1, wherein the pressing member detaches the first movable contact from the first fixed contact and detaches the second movable contact from the second fixed contact, and the pressing member detaches the second movable contact from the second fixed contact after detaching the first movable contact from the first fixed contact.

4. The electromagnetic relay as claimed in claim 1, wherein the pressing member includes a first detachment portion that detaches the first movable contact from the first fixed contact and a second detachment portion that detaches the second movable contact from the second fixed contact, and a distance from the first elastic body to the first detachment portion is shorter than a distance from the second elastic body to the second detachment portion.

5. The electromagnetic relay as claimed in claim 4, wherein the first elastic body includes a third elastic body that is pressed by the first contact pressing portion, and a fourth elastic body that overlaps with the third elastic body and is pressed by the first detachment portion, and the second elastic body includes a fifth elastic body that is pressed by the second contact pressing portion, and a sixth elastic body that overlaps with the fifth elastic body and is pressed by the second detachment portion.

6. The electromagnetic relay as claimed in claim 1 wherein a width of the first elastic body at a portion with which the first contact pressing portion comes in contact is narrower than a width of the second elastic body at a portion with which the second contact pressing portion comes in contact.

7. The electromagnetic relay as claimed in claim 1, wherein a direction of a current which flows into the first movable contact or flows out from the first movable contact, and a direction of a current which flows into the first fixed contact or flows out from the first fixed contact are the same direction, and a direction of a current which flows into the second movable contact or flows out from the second movable contact, and a direction of a current which flows into the second fixed contact or flows out from the second fixed contact are the same direction.

8. An electromagnetic relay comprising:

a first movable contact that comes in contact with a first fixed contact;

a second movable contact that comes in contact with a second fixed contact;

a first elastic body that biases the first movable contact;

a second elastic body that biases the second movable contact; and a pressing member that presses the first elastic body and contacts the first movable contact to the first fixed contact, presses the second elastic body and contacts the second movable contact to the second fixed contact;

wherein the pressing member contacts the second movable contact to the second fixed contact before contacting the first movable contact to the first fixed contact, wherein a width of the first elastic body between the first movable contact and a fixed potion of the first elastic body is wider than a width of the second elastic body between the second movable contact and a fixed portion of the second elastic body.

9. An electromagnetic relay comprising:

a first movable contact that comes in contact with a first fixed contact;

a second movable contact that comes in contact with a second fixed contact;

a first elastic body that biases the first movable contact;

a second elastic body that biases the second movable contact; and a pressing member that presses the first elastic body and contacts the first movable contact to the first fixed contact, presses the second elastic body and contacts the second movable contact to the second fixed contact, wherein the pressing member contacts the second movable contact to the second fixed contact before contacting the first movable contact to the first fixed contact, and wherein the first elastic body curves between the first movable contact and a fixed portion of the first elastic body, and the second elastic body curves between the second movable contact and a fixed portion of the second elastic body.

* * * * *

UNITED STATES PATENT AND TRADEMARK OFFICE

CERTIFICATE OF CORRECTION

PATENT NO. : 9,305,718 B2
APPLICATION NO. : 14/248772
DATED : April 5, 2016
INVENTOR(S) : Daiei Iwamoto It is certified that error appears in the above-identified patent and that said Letters Patent is hereby corrected as shown below:

Claims

Claim 8, Column 10, Line 5:
Delete "potion" and insert -- portion --, therefor.

Signed and Sealed this
Nineteenth Day of July, 2016

Michelle K. Lee

Michelle K. Lee
*Director of the United States Patent and Trademark Office*